US006851551B2

(12) United States Patent
Lemaire

(10) Patent No.: US 6,851,551 B2
(45) Date of Patent: Feb. 8, 2005

(54) CONTAINER FOR COINS OR TOKENS

(75) Inventor: Réal Lemaire, Drummondville (CA)

(73) Assignee: Emballage Conseil 2000 Inc., St-Nicephore (CA)

( * ) Notice: Subject to any disclaimer, the term of this patent is extended or adjusted under 35 U.S.C. 154(b) by 53 days.

(21) Appl. No.: 10/189,015

(22) Filed: Jul. 5, 2002

(65) Prior Publication Data

US 2004/0004011 A1 Jan. 8, 2004

(51) Int. Cl.[7] ..... A45C 1/00

(52) U.S. Cl. ..... 206/0.83; 206/0.84; 206/303; 220/4.23

(58) Field of Search ..... 206/0.82, 0.83, 206/0.84, 303, 445, 748; 220/4.21, 4.22, 4.23, 835, 839; 229/406; D9/424, 426; D21/392, 393

(56) References Cited

U.S. PATENT DOCUMENTS 3,127,009 A * 3/1964 Feis et al.
D204,323 S * 4/1966 Bostrom
3,372,812 A * 3/1968 Parcels
3,396,867 A * 8/1968 Garriga
3,948,455 A * 4/1976 Schwartz
4,129,211 A * 12/1978 Clement et al.
4,183,432 A 1/1980 Lemaire
4,290,523 A * 9/1981 Wallace
D276,590 S * 12/1984 Lobel
5,156,267 A * 10/1992 Yates, Jr. et al.
5,957,275 A 9/1999 Lemaire

* cited by examiner

*Primary Examiner*—David T. Fidei
(74) *Attorney, Agent, or Firm*—Ogilvy Renault

(57) ABSTRACT

A coin container for receiving coins or tokens therein, comprising a receptacle having a longitudinal wall along a longitudinal axis and end faces at opposed ends of the longitudinal wall. The longitudinal wall has an inner surface defining a cavity portion with the end faces. The cavity portion is adapted to partially receive therein a predetermined number of coins. Grooves protrude radially in the inner surface of the longitudinal wall. The grooves are adapted to receive partially therein at least one coin of the predetermined number of coins thereby separating other ones of the predetermined number of coins in groups of the predetermined number of coins, such that the coins in the grooves are offset radially from the groups. Means are provide for forming a tubular container with the cavity portion of the receptacle to hold the coins captive in the tubular container.

17 Claims, 3 Drawing Sheets

44B
58B
14B
16
12
48B
54B
20
24
42B
56B
26
46B
56B
50B
30B
C2
C1

20
24
54A
44A
48A
30A
56A
56A
48A
42A
40A
42A
48A
40A
54A
50A
44A

CONTAINER FOR COINS OR TOKENS

TECHNICAL FIELD

The present invention generally relates to transparent containers for holding predetermined numbers of coins or tokens in a securable manner.

BACKGROUND ART

U.S. Pat. No. 4,183,432, issued to the present applicant on Jan. 15, 1980, discloses a transparent coin holder comprising two semicylindrical open-faced receptacles formed from a transparent plastic material. The semicylindrical receptacles are interconnected along a common edge parallel to a longitudinal axis of the semicylindrical receptacles. Semicircular end walls are provided at opposite ends of each receptacle. The semicylindrical receptacles are hinged toward one another in order to form a cylindrical cavity of a predetermined length so as to receive therein a predetermined number of coins. An outer surface of a first one of the semicylindrical receptacles has protrusions thereon, whereas a flap hinged to an outer edge of a second one of the semicylindrical receptacles has indentations that will be in register with the protrusions by hinging the flap over the first one of the semicylindrical receptacles when the semicylindrical receptacles are opposed to receive coins therebetween. Accordingly, the protrusions and the indentations matingly engage with one another thereby securing the semicylindrical receptacles with one another.

U.S. Pat. No. 5,957,275, issued on Sep. 28, 1999 to the present applicant discloses a container made of a moldable plastic sheet. The container comprises three semicylindrical receptacles, each defining two compartments. Each of the semicylindrical receptacles has semicircular end faces at ends thereof. A first one of the semicylindrical receptacles, preferably the middle one, is adapted to receive therein coins. The two compartments of the middle semicylindrical receptacle separate the coins into two portions. Once coins are positioned in the first semicylindrical receptacle, a second one of the semicylindrical receptacles is hinged towards the middle semicylindrical receptacle to form a cylindrical cavity wherein the coins will be in captive engagement. The third one of the semicylindrical receptacles is hinged toward the cylindrical receptacle holding the coins so as to engage a detachable engagement therewith, via mating connectors on the semicircular ends thereof.

In designing reusable containers for coins or tokens, a plurality of factors must be taken into account. One such factor is the lack of consistency in the thickness of the tokens or coins for which the containers are designed. Coins of a same type and value are struck according to thickness tolerances. For this reason, a reusable container receiving a plurality of coins struck at the upper end of the thickness tolerance will most likely be too short for such coins. Older coins can also be thinner because of the wear and tear they have sustained over time. Another factor resides in that countries may change thickness standards for their coins, whereby some newer coins may be thicker or thinner than older coins. Also, some countries have changed monetary systems, and this may cause other problems. For instance, most of the countries forming the European community have now decided to use the euro. The euro coins are struck in a few countries and a lack of thickness consistency has been reported. For these reasons, the number of coins in the reusable containers can often be off by a few units.

Some types of coin containers are designed to be reused. However, the mating connectors that ensure the integrity of the closed coin-packed containers lose their effectiveness over time. More precisely, the male portions of the connectors lose their structural integrity and shape over time, and therefore do not provide as much friction to the female portions of the connectors. On the other hand, the female portions become too large over time, such that the male portions are loose therein. Accordingly, after a few uses, the mating connectors are not as effective as they initially were. Therefore, after a few uses, the containers must either be secured with a further adhesive, e.g., adhesive tape, or discarded.

Also, the reusable containers are not known to resist shock too well. As the reusable containers show a smooth, cylindrical outer surface, when they are subjected to a shock, the coins in the reusable containers have a tendency to be ejected out of the containers.

SUMMARY OF INVENTION

It is a feature of the present invention to provide a coin container that substantially overcomes the disadvantages of the prior art.

According to the above features of the present invention, from a broad aspect, there is provided a coin container for receiving coins or tokens therein, comprising a receptacle having a longitudinal wall along a longitudinal axis and end faces at opposed ends of the longitudinal wall. The longitudinal wall has an inner surface defining a cavity portion with the end faces. The cavity portion is adapted to partially receive therein a predetermined number of coins. At least one coin offsetting means is provided in the inner surface of the longitudinal wall. The at least one coin offsetting means is adapted to offset at least one coin of the predetermined number of coins thereby separating other ones of the predetermined number of coins in at least two groups of the predetermined number of coins, such that the at least one coin against the coin offsetting means is offset radially from the at least two groups. Closing means are provided for forming a tubular container with the cavity portion of the receptacle to hold the coins captive in the tubular container.

According to a further broad feature of the present invention, there is provided a coin container for receiving coins or tokens therein, comprising a receptacle having a longitudinal wall along a longitudinal axis with opposed longitudinal edges and end faces at opposed ends of the longitudinal wall. The longitudinal wall has an inner surface defining a cavity portion with the end faces. The cavity portion is adapted to partially receive therein a predetermined number of coins. A first and a second flap are each connected to a respective one of the longitudinal edges. The first and the second flap are hingeable with respect to the receptacle to form a tubular container with the cavity portion of the receptacle to hold the coins captive in the tubular container. The first and the second flap have connector portions for mating engagement therebetween. The connector portions each are adapted to be any one of a female connector portion and a male connector portion.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
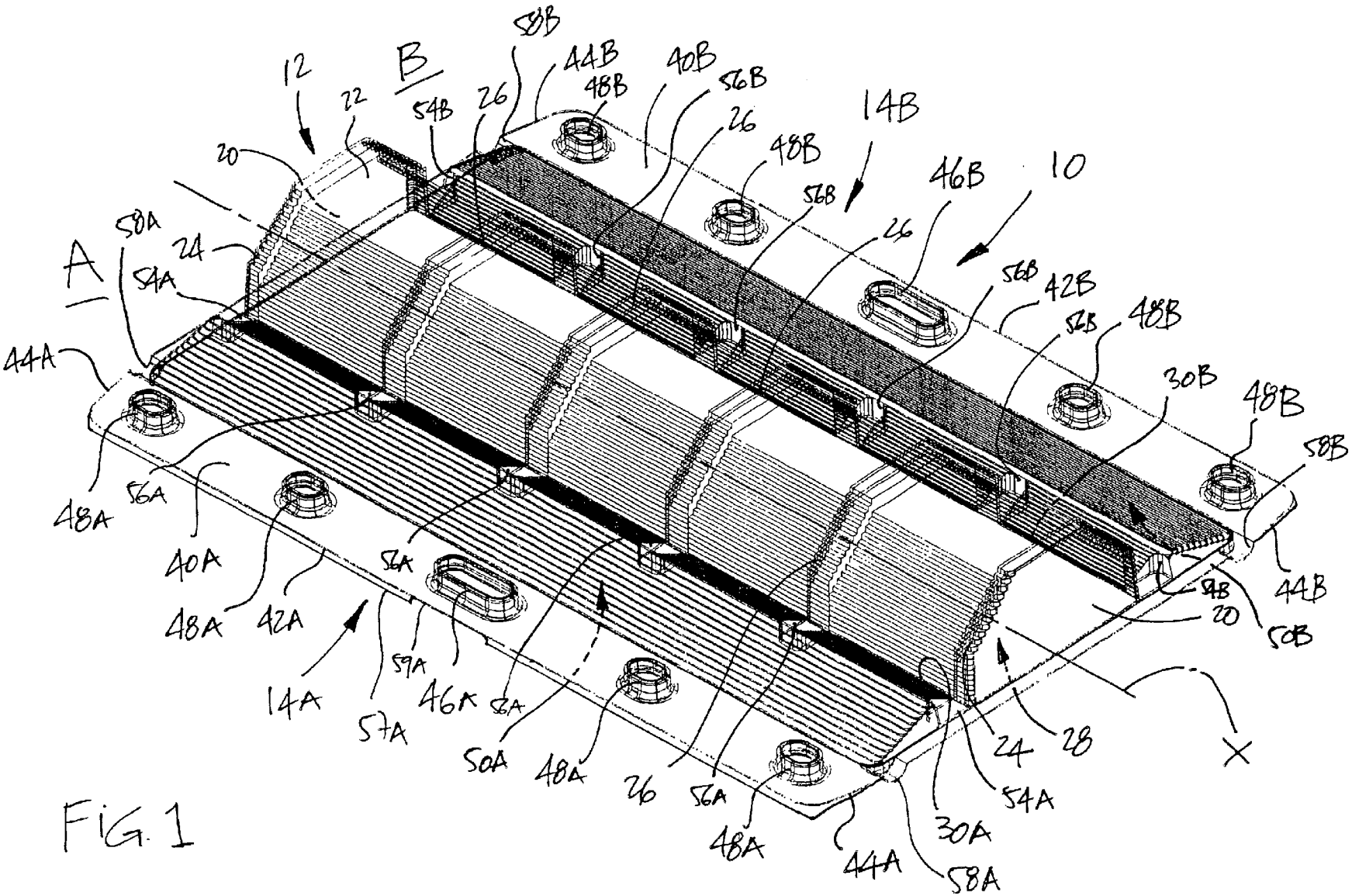
FIG. 1 is a perspective view of the coin container constructed in accordance with the present invention.

Referring to the drawings, and more particularly to FIG. 1, the coin container of the present invention is generally shown at 10. The coin container 10 is preferably formed of a sheet of transparent plastic and has a semitubular receptacle 12 and flaps 14A and 14B on opposed sides of the receptacle 12. The semitubular receptacle 12 has a longitudinal axis X. A plane going through the longitudinal axis X and generally perpendicular to a plane formed by the flaps 14A and 14B separates the coin container 10 into two symmetrical portions, A and B.

The semitubular receptacle 12 of the coin container 10 is formed of end faces 20 interconnected by a longitudinal wall 22. The end faces each represent half of an octagon. Accordingly, a cross-section of the semitubular receptacle 12 is a semioctagon. A center of the end faces 20 and of the semitubular receptacle 12 is colinear with the axis X. End ribs 24 and central ribs 26 project radially from the longitudinal wall 22 so as to create grooves protruding radially into an inner surface of the receptacle 12. The end ribs 24 coincide with the end faces 20. The receptacle 12 defines an inner cavity 28 that is defined by inner surfaces of the end faces 20, the longitudinal wall 22, the end ribs 24 and the central ribs 26. As shown in FIG. 1, there are four central ribs 26 and the central ribs 26 are generally twice as thick as the end ribs 24 in the longitudinal direction of the receptacle 12. The spacing between each adjacent pair of ribs 24 and/or 26 is the same. The longitudinal wall 22 defines longitudinal edges 30A and 30B.

Still referring to FIG. 1, the flaps 14A and 14B are shown being connected to the receptacle 12 at the longitudinal edges 30A and 30B thereof, respectively. As the flaps 14A and 14B are symmetrically identical, one general flap 14 will be described. However, when referring to the drawings, the reference numerals used in the description for describing the general flap 14 will have the letter "A" or "B" affixed thereto, depending on which of side "A" or "B" they are. Therefore, unless specified in the description, when an element of the flap 14 is referred to without an affixed letter, it will designate an element on both flaps.

The flap 14 is hinged to the receptacle 12 by sharing the longitudinal edge 30 therewith. The flap 14 has a generally flat wall 40, having a longitudinal edge 42 opposite the longitudinal edge 30. End edges 44 are generally perpendicular to the longitudinal edge 42 and limit the flat wall 40 longitudinally. Connector protrusions 46 and 48 are defined in the flat wall 40 and are aligned with respect to one another so as to be generally parallel to the longitudinal axis X of the coin container 10. They are disposed substantially mid-length of the flaps 14. The connector protrusions 46 and 48 each have an oblong cross-section, but the connector protrusion 46 has a greater length dimension than the connector protrusions 48. The connector protrusions 46 and 48 are preferably slightly flared toward the flat wall 40. A cavity portion 50 is defined in the flat wall 40 and has an edge portion thereof colinear with the longitudinal edge 30. Coin-holding protrusions 54 and 56 project into the cavity portion 50. The protrusions 54 are positioned at ends of the end ribs 24 of the receptacle 12, whereas the protrusions 56 are positioned at end of the central ribs 26 of the receptacle 12. Bumps 58 protrude downwardly in the flat wall 40 with respect to FIG. 1, and are positioned between the cavity portion 50 and the end edges 44. A lip 57 projects downwardly from the longitudinal edge 42 and a portion of the end edges 44. The lip 57 is disrupted by a slot 59 adjacent to the connector protrusion 46.

Figures 2, 4:
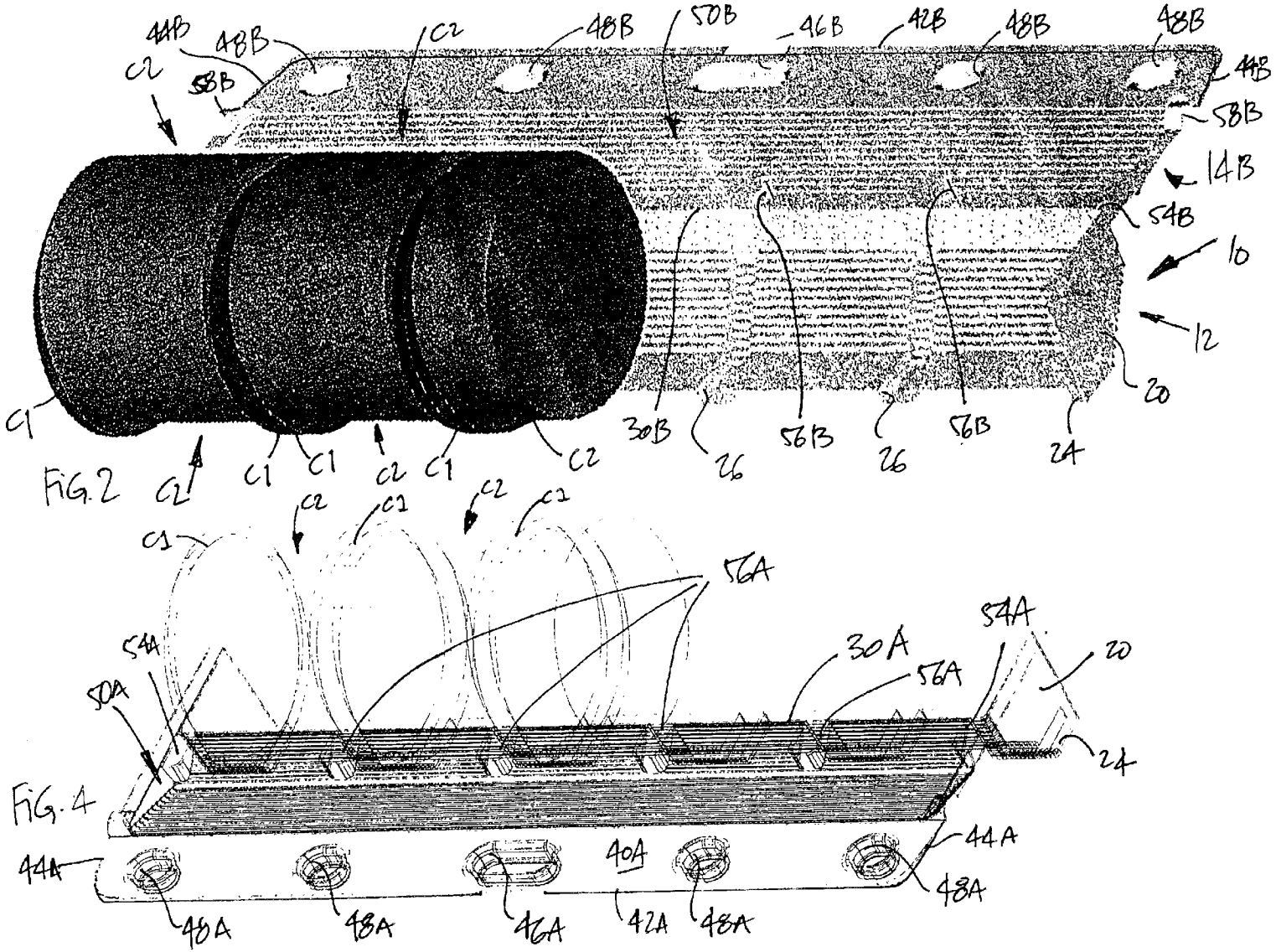
FIG. 2 is a sectioned perspective view of the coin container having coins therein.
FIG. 4 is a sectioned perspective view of the coin container having coins therein.
Figure 3:
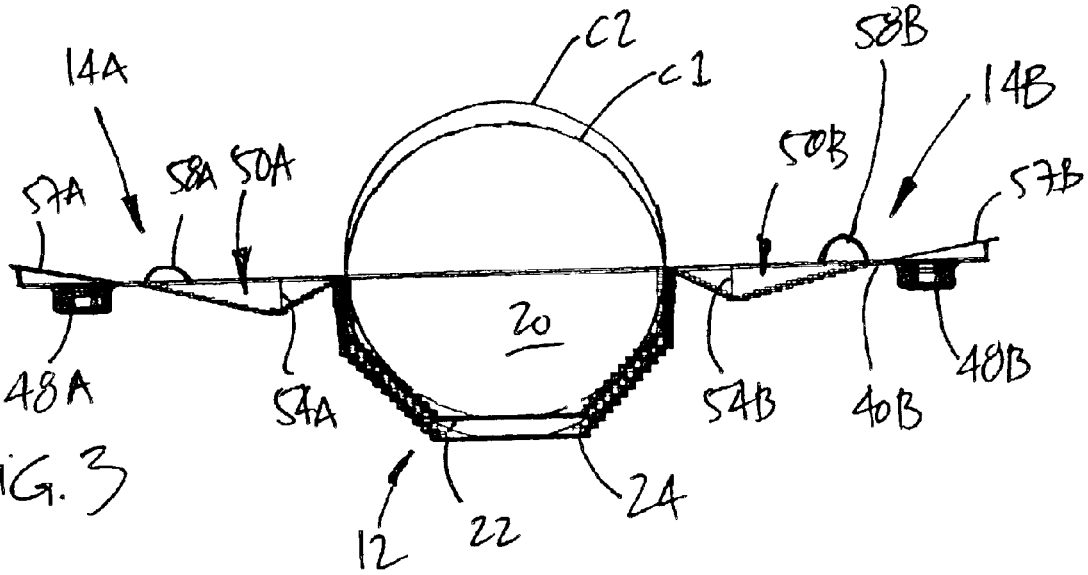
FIG. 3 is a front elevational view of the coin container in an open position and having coins therein.

Referring to FIGS. 2 to 4, coins are shown inserted into the inner cavity 28 of the coin container 10. All coins are of a same type and value, yet are identified differently by "C1" and "C2" in the figures to indicate the position in which they are in the inner cavity 28. The coins C1 are received in grooves formed by the end ribs 24 or the central ribs 26, whereas the coins C2 abut against an inner surface of the longitudinal wall 22. It is pointed out that, as the central ribs 26 are twice as thick in the longitudinal dimension of the coin container 10 as the end ribs 24, the grooves formed by the central ribs 26 each supportingly receive two coins C1, whereas the grooves formed by the end ribs 24 each supportingly receive one coin C1. The coins C2 are aligned and centered with respect to the longitudinal axis X. On the other hand, the coins C1 are radially offset with respect to the longitudinal axis X. As shown in FIG. 3, the coins C1 are eccentrically positioned with respect to the coins C2. Therefore, as best seen in FIG. 2, the coins C1 of grooves of adjacent ribs 24 and/or 26 define compartments therebetween within the inner cavity 28. The ribs 24 and/or 26 are spaced such that a predetermined number of coins C1 can be received in the compartments. Obviously, it is preferred that the spacing between adjacent ribs 24 and/or 26 be the same throughout the coin container 10 such that the compartments are each adapted to receive a same number of coins (i.e., groups of coins). For instance, the coin container 10 illustrated in FIGS. 1 to 5 has five compartments of eight coins. Therefore, the coin container 10 has forty coins C2 and eight coins C1 in the grooves formed by the central ribs 26, and two coins C1 in the grooves formed by the end ribs 24, such that fifty coins are received in the coin container 10. Various other configurations may be suitable, and factors such as the coin thickness, the coin value and weight can influence the choice of configuration. It is obvious that other amounts of coins can be received in the coin container 10. Furthermore, other construction of the container 10 can be suitable, so long as compartments are defined by a few coins offset from the other coins. For instance, ribs (not shown) may protrude in the inner cavity 28 rather than creating grooves therein.

Once the coins C1 and C2 are received in the inner cavity 28 of the semitubular receptacle 12, either one of the flaps 14 is hinged towards the coins C1 and C2. More precisely, in FIG. 5, the flap 14A is hinged towards the coins C1 and C2 such that the coins C1 and C2 are received in the cavity portion 50A of the flap 14A. The coin-holding protrusions 54A and 56A will ensure that the coins C1 stay in the grooves formed in their respective rib 24 or 26. Thereafter, the flap 14B is hinged towards the coins C1 or C2, whereby the coins C1 and C2 will also be received in the cavity portion 50B. Once more, the coin-holding protrusions 54B and 56B will block the coins C1 in the grooves formed by the ribs 24 and/or 26, and the bumps 58 will keep the end coins within the cavity 28.

Figure 5:
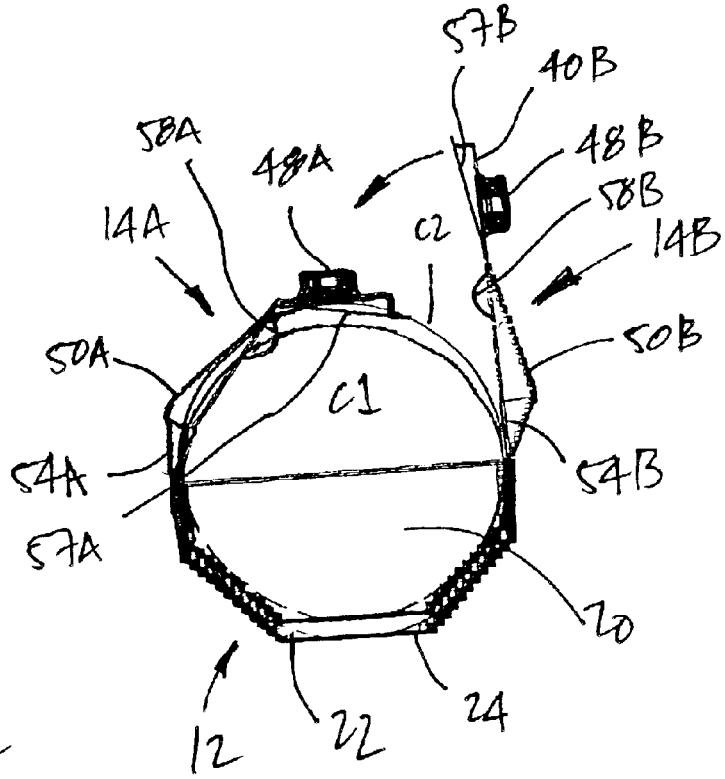
FIG. 5 is a front elevational view of the coin container having coins secured therein and illustrating how flaps thereof are closed for engagement.

Once the flaps 14A and 14B are hinged over the coins C1 and C2, the connector protrusions 46A and 46B, and 48A and 48B, respectively, will be in register. Therefore, the connector protrusions 46 and 48 will matingly engage in order to secure the flaps to one another and hold captive the coins C1 and C2 in the inner cavity 28. In FIG. 5, the connector protrusions 46A and 48A act as the male connectors, whereas the connector protrusions 46B and 48B are the female connectors. It is advantageous that the connector protrusions 46 and 48 can either serve as male connectors or female connectors. They can be used alternatively in each connector position such that they will not lose their shape. For instance, in a first use of a coin container 10, the flap 14A can be below the flap 14B, whereby the connector protrusions 46A and 48A will serve as male connectors, while the connector protrusions 46B and 48B will serve as female connectors. In a further use of the coin container 10, the flap 14B can be below the flap 14A, whereby the connector protrusions 46B and 48B will be the male connectors, while the connector protrusions 46A and 48A will serve as female connectors. Therefore, the connector protrusions 46A and 48A, which were compressed in the first use, will regain their shape in the further use by being stretched in the further use as female connectors. To the opposite, the connector protrusions 46B and 48B were stretched in the first use of the coin container 10, but will be compressed in a further use to regain their shape. In this way, the coin container 10 has a durable connector system that will sustain numerous closing/opening cycles. When the connector protrusions 46 and 48 do not hold, it is an indication to the user to reverse the flaps 14 to secure the container 10. Also, the lip 57 adds rigidity to the portion of the flat wall 40 from which the connector protrusions 46 and 48 protrude, and this will ensure that the connector protrusions 48 do not become disconnected because of a deformation in the flat wall 40. The slot 59 is provided so as to detach the flaps 14 from one another therethrough. For instance, the slot 59 can be large enough to be caught by a person's nail.

The types of plastics used for the coin container 10 of the present invention vary to a large extent. As mentioned previously, the coin container consists of a plastic sheet material, preferably transparent, such as PET or PVC, that is thermoformed. As the coin container 10 is longitudinally and radially symmetrical, the molding thereof is facilitated and uniformized.

In addition to being centrally positioned in the longitudinal dimension of the coin container 10, the connector protrusions 46 are longer than the connector protrusions 48. This is to influence a user of the coin container 10 to close the coin container 10 by first mating the connector protrusions 46. This will ensure the proper mating of the flaps 14 to one another, as the central position of the connector protrusions 46 and their relatively greater length will ensure that the connector protrusions 48 will be aligned thereafter. Also, the greater amount of contact surface between mating protrusions 46 resulting from the large size of the protrusions 46 will ensure a proper friction therebetween, whereby the protrusions 46 will remain connected while the protrusions 48 are being connected. It is also possible to add a color to a top surface of the connector protrusions 46, once more to influence a user of the coin container 10 to close the coin container 10 by first mating the connector protrusions 46. The color preferably coincides with the code color of the coins the coin container should receive. Also, the color is preferably added once the molded coin container is ejected from the mold and cut into its sale configuration such that the color does not affect the waste removed in the cutting operations. Uncolored waste is preferred for recycling.

It is also advantageous to have the coins divided in numerous compartments when received in the coin container 10. In this way, variations in coin thicknesses will not cause unexpected numbers of coins to be received in the coin container 10. More precisely, in a prior art container having an inner cavity wherein fifty coins are aligned side-by-side, the variations in thicknesses are added up for the fifty coins whereby they may exceed the thickness of a coin such that more than fifty coins are receivable in the container 10. Furthermore, it is a difficult task to count the number of coins in such prior art containers. Separating a fifty-coin cavity into a plurality of compartments and separating these compartments from one another such that a coin container has independent coin compartments reduces the possibility of an unexpected number of coins being received in the coin container. For instance, the coin container 10 of FIGS. 1 to 5 has five eight-coin compartments, and the tolerances or variations in coin thicknesses will be multiplied by eight rather than by fifty, with respect to the prior art container described above.

The coin container 10 of the present invention facilitates the calculation of the coins it holds. For instance, a cash-counter clerk does not have to count all coins in the coin container 10 after having removed a few coins out of it to ascertain the number of coins that are remaining in the coin container. It will be a straightforward, visual and much quicker operation for the cash-counter clerk to count how many coins are in the coin container 10. Therefore, the time taken to count the money in the coin container 10 is greatly reduced.

As the closed coin container 10 has a generally octagonal cross-section, it now has flat surfaces that will keep the coin container 10 stable on a flat surface. Moreover, the flat surfaces are more readily embossed with characters so as to identify trademarks or other printed or embossed indications (e.g., the dollar value of a full container). However, other cross-sections may also be provided for the coin container 10, such as the circle and polygonal shapes such as the hexagon, the decagon, etc.

The ribs 24 and 26 protrude from the longitudinal wall 22 will enhance the shock absorption capabilities of the coin container 10. More precisely, if the coin container 10 filled with coins is dropped, the shock will be distributed on the ribs 24 and/or 26 rather than on the full flat surface of the longitudinal wall 22. Moreover, the ribs 24 and 26 provide flexibility along the longitudinal axis.

Although the flaps 14 have been illustrated, it is pointed out that other configurations can be used, such as three semitubular receptacles with at least the outer ones being symmetrical. In this way, the end coins C1 would be completely covered to lessen the risk of these coins being inadvertently ejected from the coin container 10.

It is within the ambit of the present invention to cover any obvious modifications of the preferred embodiment described herein, provided such modifications fall within the scope of the appended claims.

What is claimed is:

1. A coin container for receiving coins or tokens therein, comprising:

a receptacle having a longitudinal wall along a longitudinal axis and end faces at opposed ends of the longitudinal wall, the longitudinal wall having an inner surface defining a cavity portion with said end faces, the cavity portion adapted to partially receive therein a predetermined number of coins, and at least one coin offsetting means in said inner surface of said longitudinal wall, said at least one coin offsetting means adapted to offset at least one coin of the predetermined number of coins thereby separating other ones of the predetermined number of coins in at least two groups of the predetermined number of coins centered on the longitudinal axis, such that the at least one coin against the coin off setting means is offset radially from said at least two groups such that the at least one coin is off-centered with respect to the longitudinal axis; and closing means for forming a tubular container with the cavity portion of the receptacle to hold the coins captive in the tubular container.

2. The coin container according to claim 2, wherein the at least one coin offsetting means is a groove in said inner surface.

3. The coin container according to claim 1, wherein said closing means comprises a first and a second flap each connected to a respective longitudinal edge of the longitudinal wall, the first and the second flap being hingeable with respect to the receptacle to form the tubular container with the cavity portion of the receptacle, the first and the second flap having connector portions for mating engagement therebetween, the connector portions each being adapted to be any one of a female connector portion and a male connector portion.

4. The coin container according to claim 3, wherein the first and second flaps each have a plurality of connector portions, and a middle one of the connector portions of the first and the second flaps has a greater length than other ones, of the connector portions for influencing a container user to firstly engage sad middle one of the connector portions to one another such that said other ones of the connector portions are aligned for mating engagement thereafter.

5. The coin container according to claim 4, wherein the middle one of the connector portions has a portion thereof colored.

6. The coin container according to claim 2, wherein said groove creates a rib on an outer surface of the longitudinal wall for enhancing a shock absorption capacity of the reusable container.

7. The coin container according to claim 6, wherein the longitudinal wall has at least three ribs, and two of said at least three ribs are coincident with said end faces.

8. The coin container according to claim 1, wherein the receptacle has a generally semioctagonal cross-section, and the tubular container has a generally octogonal cross-section.

9. The coin container according to claim 1, wherein the longitudinal wall has at least one generally planar surface for receiving information embossed or printed thereon.

10. The coin container according to claim 2, wherein, said groups each have an equal number of coins.

11. The coin container according to claim 10, wherein the number of said at least two groups is five, said equal number of coins of said groups is eight, the number of said at least one groove is six, and the number of said at least one coin received in said grooves is ten.

12. The coin container according to claim 1, wherein the coin container is reusable.

13. A coin container for receiving coins or tokens therein, comprising:

a receptacle having a longitudinal wall along a longitudinal axis with opposed longitudinal edges and end faces at opposed ends of the longitudinal wall, the longitudinal wall having an inner surface defining a cavity portion with said end faces, the cavity portion adapted to partially receive therein a predetermined number of coins; and a first and a second flap each connected to a respective one of the longitudinal edges, the first and the second flap being hingeable with respect to the receptacle to form a tubular container with the cavity portion of the receptacle to hold the coins captive in the tubular container, the first and the second flap having connector portions for mating engagement therebetween, the connector portions each being adapted to be any one of a female connector portion and a male connector portion, wherein the first and the second flap each have lip on outer edges thereof for increasing a rigidity thereof, a slot being provided in each said lip to separate the flaps therethrough when the flaps are connected to one another.

14. The coin container according to claim 13, wherein the first and second flaps each have a plurality of connector portions and a middle one of the connector portions of the first and the second flaps has a greater length than other ones of the connector portions for influencing a container user to firstly engage said middle one of the connector portions to one another such that said other ones of the connector portions are aligned for mating engagement thereafter.

15. The coin container according to claim 13, wherein the receptacle has a generally semioctagonal cross-section, and the tubular container has a generally octogonal cross-section.

16. The coin container according to claim 13, wherein the longitudinal wall has at least one generally planar surface for receiving information embossed or printed thereon.

17. A coin container for receiving coins or tokens therein, comprising:

a receptacle having a longitudinal wall along a longitudinal axis with opposed on longitudinal edges and end faces at opposed ends of the longitudinal wall, the longitudinal wall having an inner surface defining a cavity portion with said end faces, the cavity portion adapted to partially receive therein a redetermined number of coins; and a first and a second flap each connected to a respective one of the longitudinal edges, the first and the second flap being hingeable with respect to the receptacle to form a tubular container with the cavity portion of the receptacle to hold the coins captive in the tubular container, the first and the second flap having connector portions for mating engagement therebetween, the connector portions each being adapted to be any one of a female connector portion and a male connector portion, wherein the first and second flaps each have a plurality of connector portions and a middle one of the connector portions of the first and the second flaps has a greater length than other ones of the connector portions for influencing a container user to firstly engage said middle one of the connector portions to one another such that said other ones of the connector portions are aligned for mating engagement thereafter.

* * * * *